United States Patent [19]

Comparetto

[11] 4,423,735

[45] Jan. 3, 1984

[54] DYNAMIC ORTHOTIC DEVICE CONTAINING FLUID

[76] Inventor: John E. Comparetto, P.O. Box 433, Nassawadox, Va. 23413

[21] Appl. No.: 219,737

[22] Filed: Dec. 23, 1980

Related U.S. Application Data

[63] Continuation of Ser. No. 902,614, May 3, 1978, abandoned.

[51] Int. Cl.[3] ..... A43B 7/14

[52] U.S. Cl. ..... 128/594; 128/582; 36/28

[58] Field of Search ..... 36/28, 29; 128/69, 594, 128/595, 80, 581, 582; 15/253, 69, 215, 217

[56] References Cited

U.S. PATENT DOCUMENTS

| | | | |
|---|---|---|---|
| 2,079,311 | 5/1937 | Blumenthal | 128/69 |
| 2,123,730 | 7/1938 | Hottelston | 128/594 |
| 3,121,430 | 2/1964 | O'Reilly | 128/594 |
| 3,469,576 | 9/1969 | Smith et al. | 128/595 |
| 3,845,507 | 11/1974 | Kirby et al. | 3/36 |
| 3,914,881 | 10/1975 | Striegel | 128/594 |
| 4,358,902 | 11/1982 | Cole et al. | 36/29 |

FOREIGN PATENT DOCUMENTS

| | | | |
|---|---|---|---|
| 200963 | 5/1958 | Austria | 128/594 |
| 1485683 | 4/1970 | Fed. Rep. of Germany | 128/582 |
| 338266 | 11/1930 | United Kingdom | 128/594 |
| 454529 | 10/1936 | United Kingdom | 128/594 |

OTHER PUBLICATIONS

Webster's Seventh New Collegiate Dictionary, G and C Merriam Co., Springfield, Mass., p. 802 "Shoe," and p. 982 "Varos," 1963.

*Primary Examiner*—Richard J. Apley
*Assistant Examiner*—J. L. Kruter

[57] ABSTRACT

An orthotic apparatus to help resuppinate the foot after the initial contact phase of gait. The device consisting of a flexible envelope containing a fluid with a cambered upper surface to flex upwardly upon the generation of a fluid wave along the longitudinal axis of the foot.

5 Claims, 20 Drawing Figures

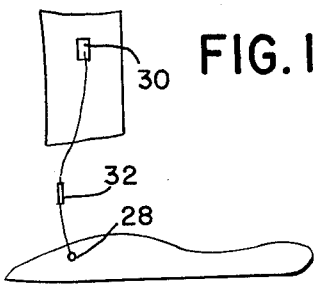
FIG. 10
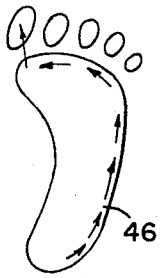
FIG. 13
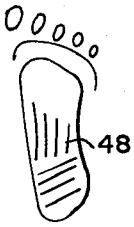
FIG. 15
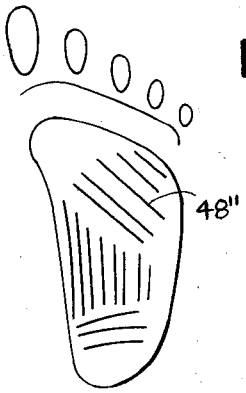
FIG. 17
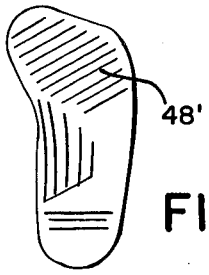
FIG. 16
FIG. 14
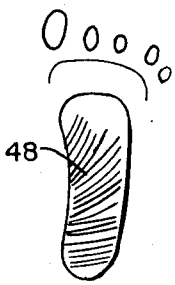
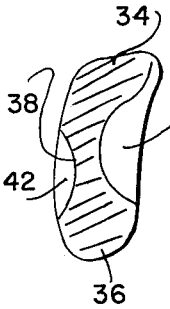
FIG. 11
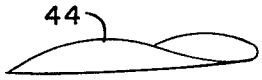
FIG. 12
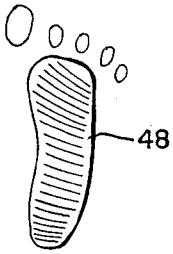
FIG. 14A

DYNAMIC ORTHOTIC DEVICE CONTAINING FLUID

This application is a continuation, of application Ser. No. 902,614, filed May 3, 1978 abandoned.

BACKGROUND OF THE INVENTION

Presently orthoses are made for functional control of gait; effecting a more favorable bony alignment through which the muscles of ambulation can work to a maximum efficiency for the individual patient.

The orthoses are fabricated from positive models of negative "slipper" casts made of the patient's foot in a position deemed most advantageous by the podiatrist. This position is usually the neutral subtalar joint position or a position slightly pronated from this. The neutral position of the subtalar joint is designated as the position that the subtalar joint is neither pronated nor supinated and is apparent to those practiced in the art of podiatric medicine.

When the neutral position of the patient is in a varus (or valgus) heel position, i.e. inverted (or everted) in the frontal body plane related to mid line of the body; orthotics are fabricated that capture the plantar surface of the foot (through casting mentioned above). They have a "post" built in that brings the ground up to the foot.

Further, the orthotic serves to keep the osseous alignment in the foot in a more favorable attitude.

The patient, for example, with a rearfoot varus (that is with a calcaneal and lower leg positional attitude in a varus position) will pronate the subtalar joint in an excessive manner in order to get the foot down on the ground after heel strike. This pronation of the subtalar joint consists of eversion, abduction, and dorsiflexion of the calcaneous.

Normally a certain amount of pronation occurs within the first 27% on the stance phase of gait and continues until resupination occurs toward 67% of stance phase. Pronation of the subtalar joint unlocks the mid-tarsal joint since the longitudinal and oblique axis of the mid-tarsal joint become parallel allowing for mobile adaptation of the foot over the terrain. With supination of the subtalar joint the axis of the mid-tarsal joint intersect locking the mid-tarsal joint for the foot to assume the character of a rigid lever for propulsion at toe off. In the pathologically pronating foot no resupination (or not enough) of the subtalar joint occurs and therefore the mid-tarsal joint remains unlocked, the foot does not become a rigid level and subsequent hypermobility of the forefoot with subluxation of its joints begins. The last aspect of the functional orthotic is the fabrication of a balanced or posted forefoot either intrinsically posted (balanced) or extrinsically posted as with dental acrylic posts. While the negative casts were made with the patient in the neutral subtalar position the forefoot was maximally pronated to lock the mid-tarsal joint and in so doing capture in the cast the forefoot deformity valgus or varus (frontal body plane attitudes of the forefoot). This forefoot position is negated by "bringing the ground up to the foot"; again, this is accomplished by posting.

The orthotics are fabricated from various materials. The more rigid the material the greater the functional control; however rigidity must be sacrificed for flexibility in many instances when treating athletes. Leather laminates, Korex, cork and leather, "rubber butter", polyethylene, rohadur are the most common—the last two the most frequently used.

While great attention has been given to passive orthotics either in rigid or flexible materials, no dynamic orthotic has heretofore been developed to provide desired features of softness and support. No dynamic orthotic has heretofore been developed to provide support to the desired part of the foot base at precisely the right time in foot movement. No dynamic orthotic has heretofore been developed to accurately sequence support to precise foot base areas.

OBJECTS OF THE INVENTION

Objects of the invention are to provide an orthotic apparatus comprising a bag having rearward, medial, and forward portions, fluid disposed in the bag, upward hollow extensions having open bases connected to at least one of the portions and communicating with an exterior of the bag for fluid between the bag and the extensions and changing yieldability of that at least one portion in response to distortion of at least one portion of the bag.

Another object of the invention is to provide a bag having two parts; one part filled with fluid of varied characteristics whenever the extensions are located in a first part and are influenced to change by flow of first fluid in the first part in response to flow of second fluid in the second part.

Another object of the invention is to provide a bag made from polymeric material.

Another object of the invention is to provide a bag which is distensible.

Another object of the invention is to provide a bag canted to support a forefoot.

Another object of the invention is to provide a bag having a varus post to support a rear foot.

Another object of the invention is to provide fluid comprising liquids of varying densities.

Another object of the invention is to provide fluid flowing through a bag causing dynamic contractions of the bag.

Another object of the invention is to provide fluid which is a self-sealing adhesive.

Another object of the invention is to provide extensions comprising rugae.

Another object of the invention is to provide extensions comprising villi.

Another object of the invention is to provide triggering means comprising micro-switches or pressure sensitive devices.

Another object of the invention is to provide extensions comprising ridges positioned in fan shaped arrangement.

Another object of the invention is to provide extensions which are ridges positioned longitudinally to a length of a foot and laterally at a rear foot.

Another object of the invention is to provide extensions which are ridges positioned longitudinally in the medial portions under an arch of a foot, laterally at a rear foot and angularly at a forefoot forward portion.

The invention has as another object the provision of a dynamic orthotic.

Another object of the invention is the provision of a dynamic orthotic which moves support in desired sequence from one area of a foot base to another.

A further object of the invention is the provision of a dynamic orthotic which cushions foot in part by flowing fluid from the impact area to other areas and causing those areas to properly sequentially support other areas of the foot base.

BRIEF DESCRIPTION OF THE DRAWINGS

FIG. 10 shows an electrical circuit which uses the fluid wave within the orthotic of the present invention to fire a sluggish muscle.

FIG. 11 is a top plan of one form of the dynamic orthotic of the present invention.

FIG. 12 shows a side elevational view of the orthotic shown in FIG. 11.

FIG. 13 is a schematic view of a foot showing the desired support sequencing from heel strike to toe off.

FIG. 14 shows fanned rugae for varus in dynamic orthotic of the present invention.

FIG. 14*a* shows fanned rugae for valgus in a dynamic orthotic of the present invention.

FIG. 15 shows a dynamic orthotic with arch support.

FIG. 16 shows a dynamic orthotic for varus, and FIG. 17 shows a dynamic orthotic for valgus.

DETAILED DESCRIPTION OF THE DRAWINGS

Figure 1:
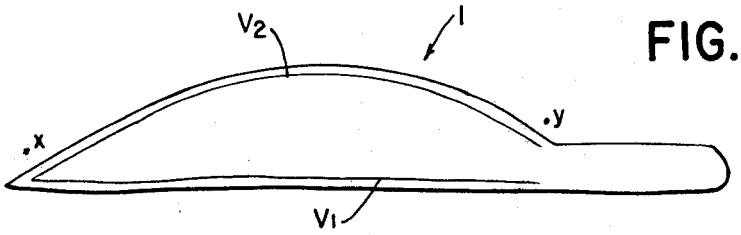
FIG. 1 is a schematic of a fluid filled dynamic orthotic of the present invention.

FIG. 1 shows a camber like system as seen in an airplane wing. Herein we are depicting the flow against the inside surface of the camber rather than on the outside as in an airplane wing. The speed of flow is different at $V_1$ than at $V_2$ in addition the time of flow, if this system was open ended as in a pipe, would be longer for a particle of fluid to travel from Y to X at level $V_2$ than $V_1$. The same may be said for FIG. 2 only here the differences would be greater. Further, it should be noted that due to the difference of liquid flow at levels $V_2$ $V_1$ and $V_2^1$ $V_1^1$ the tendency of a flexible container would be to flex upon itself as indicated by arrows 2 and 4.

This invention utilizes this principal in phase one. To a cast-model of the patient's foot in the subtalar neutral position a soft plastic orthotic is fabricated having at the model planar surface conformity as depicted 6 in FIG. 3.

This plastic surface 6 becomes the upper portion or against the foot portion of the fluidic orthotic. Portion 8 in FIG. 4 depicts the bottom portion of the orthotic that conforms to the last shape of the average shoe.

The soft plastic material, e.g. polypropylene, mylar, etc. is filled with a fluid of suitable flow characteristics. The fluid may comprise liquids of varying densities. Ideally for economic reasons water would be first choice if the flow rate is suitable.

Figure 4:
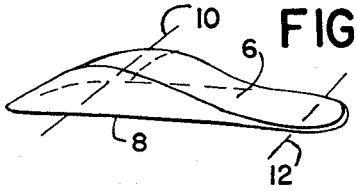
FIGS. 4, 4*a*, and 4*b* schematically show details of a dynamic orthotic of the present invention.
Figure 4A:
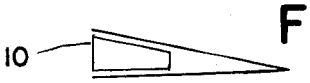
Figure 4B:
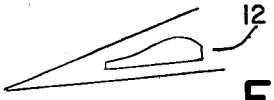

Cross section 10 schematically shown in FIGS. 4 and 4*a* depicts in this case a valgus cast for the forefoot post; cross section 12, FIG. 4*b* depicts a rearfoot varus post both of a left foot viewed posteriorly.

At heel strike a pressure wave is created at the heel portion of the fluidic orthotic. The plastic being mildly distensible absorbs some of the shock of heel strike.

Figure 2:
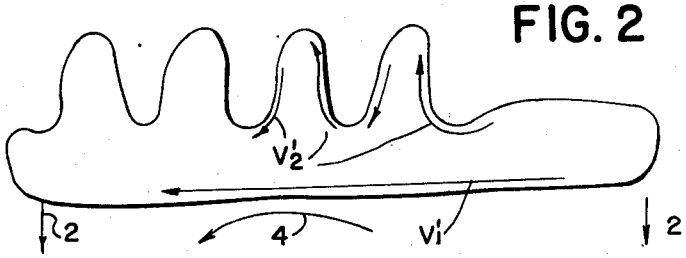
FIG. 2 is a schematic view of a preferred form of a dynamic orthotic of the present invention.

The fluid wave travels forward through the orthotic with a mild contraction of the device in a superior direction as shown in FIG. 2. To increase this upheaving of the device rugae or villi such as seen in FIG. 2 may be employed.

Figure 3:
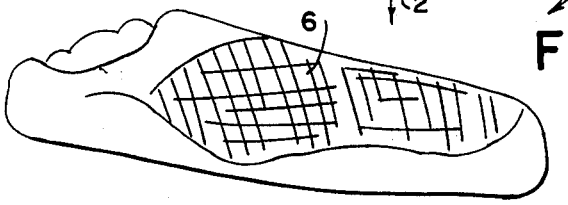
FIG. 3 is a schematic detail of casting a model preparatory to preparing an orthotic.
Figure 5:
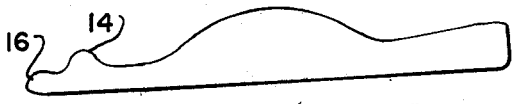
FIG. 5 is a schematic cross-sectional detail of an orthotic of the present invention showing how the orthotic may be extended forwardly beneath the toe and sulcus of a foot as shown in FIG. 6.

The device may end behind the metatarsal heads as seen in FIG. 3, or may be continued forward to 14 beneath the sulcus of the foot or to 16 beneath the toes in cases of toe contracture as seen in FIG. 5.

Figure 6:
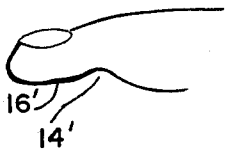

While this would be in the area of practitioners prescription it should be noted that the device could have the capability of thrusting up into the sulcus 14', FIG. 6 to aid in toe off for feet with contracted toes or beneath the toes 16' for toes lacking muscular strength to again aid in toe off.

Figure 7:
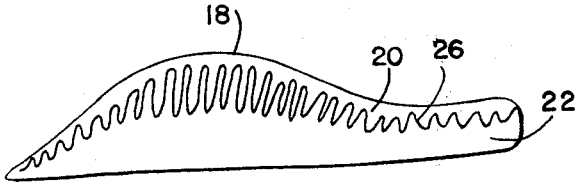
FIG. 7 shows a two compartment structure with separated fluid.
Figure 9:
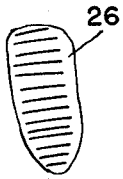
FIG. 9 is a schematic representation of an orthotic with rugae, with FIG. 8 is a schematic representation of an orthotic having villi of the present invention.

The rugae and/or villi could have a massaging effect on the foot or might be irritating. If for the purpose of additional fluidic thrust villi or rugae are needed then the orthotic would have to be enclosed, in the case of irritation, in another sheath of plastic 18 filled with fluid of a lesser density 20, FIG. 7. FIG. 9 shows a top view of rugae 26.

Figure 8:
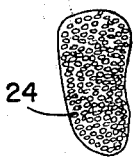

The height of the villi 24 or rugae 26 would vary the rate of $V_2$ and consequently could be altered to obtain the desired thrust. FIG. 8 shows villi 24.

The second phase of the fluidic orthotic concerns the use of the fluid wave to trigger electric stimuli to muscles. The triggers may be micro switches or pressure sensitive devices. The triggers would be placed along the length of the orthotic to correspond in time from heel strike to the time a sluggish muscle should be fired during the ensuing stance phase of gait a delayed trigger could be used for those that should fire during the swing phase of gait. It should be noted here that in most patients this would not be necessary. It should also be noted that the muscles of gait might not be in the foot or the lower leg but could be in the thigh or hip. FIG. 10 shows a muscle firing device.

From the switch 28 triggered by the fluid wave a circuit 32 is made with sufficient electrical current strength to the muscle-trigger point 30 to cause muscle contraction.

The advantage of this orthotic would be (1) shock absorption due to the distensibility of the soft plastic, (2) dynamic thrusting in area of control, (3) massage effect of fluid wave, and (4) ability to easily trigger electromyologic response with use of the fluid wave. Shaded area 34 represents a compartment with fluidic orthotic from heel region 36 to forefoot region 38 that could hold a separate fluid of same or different density than non-shaded area 40. Neck region 42 would act to both speed fluid wave to region 38 and increase thrusting in region 38 if this was desired. See FIG. 11.

It might prove desirable to encase the sides of the orthotic with a semi-rigid plastic 44 if the side flows away from the heel to toe wave propogation.

The liquid within the orthotic might be an adhesive substance that congeals and adheres at air contact for self sealing.

Further, it might be advantageous to have strappings for a sock like device to place the orthotic on the foot rather than in the shoe.

Because of the pattern of weight bearing from heel strike to toe off the ridges, the rugae would possibly be most effective in arrangement as shown in FIGS. 13, 14, 15 and 16. FIG. 16 denotes the same as FIG. 15 but with ridges 48' to place thrust under varus forefoot post. FIG. 17 shows ridges 48" for valgus posting.

Several forms of dynamic orthotics of the present invention are shown on sheet 2 of the drawings.

FIG. 11 shows the top plan of a dynamic orthotic for left foot. Upon heel strike in area 36 fluid flows forwardly through the restricted arch portion 38 into the metatarsal support area 34.

The thin medial portion provides a fitting effect in the center. Portions 40 and 42 are devoid of rugae and hence are devoid of thrusting support.

Side elevation 44 shows a general shape of one dynamic orthotic in FIG. 12.

In FIG. 13, the dashed arrows 46 show the sequential support areas for the foot.

In FIGS. 14 and 14*a* rugae 48 are arranged in a fan-like pattern. The former shows a correction for varus and promotes a gradual turning of a support wave which moves from the heel towards the first metatarsal portion. FIG. 14*a* shows opposite fanning for valgus so that the wave gradually turns toward supporting the fifth metatarsal head.

FIGS. 15 and 16 show formations of rugae 48 to support the arch, and in the case of FIG. 16 to flow from an area of the fifth metatarsal to the first metatarsal for varus.

While the invention has been described with reference to specific embodiments, it will be obvious to those skilled in the art that modifications and variations of the invention may be made without departing from the scope of the invention. The scope of the invention is defined in the following claims.

I claim:

1. An orthotic device comprising a flexible fluid enclosure having a forefoot portion, an inside upper surface means and an exterior surface means, the inside upper surface means having an opposite upper exterior surface means which is cambered and has multiple defined ridge means to moderate fluid wave motion and direction, and a lower flat wall means forming a fluid enclosure with a heel strike portion means at one end of the enclosure which upon pressure by the foot at the upper exterior surface portion means adjacent the heel strike portion means creating horizontal, longitudinal and upward directed fluid waves to force the cambered upper exterior surface means to supinate the subtalar joint from a position of pronation, the longitudinal waves providing support to the forefoot immediately prior to and during toe-off at the portion of the enclosure distal to the heel strike at the forefoot portion.

2. The device of claim 1 wherein the enclosure is of a polymeric material.

3. The device of claim 1 wherein the fluid is water.

4. The device of claim 1, wherein the fluid is of varying densities.

5. The device of claim 1, wherein the upper exterior surface means comprises ridge means to massage the foot.

* * * * *